US006547104B1

(12) United States Patent
Wilkinson

(10) Patent No.: US 6,547,104 B1
(45) **Date of Patent: *Apr. 15, 2003**

(54) COMBINATION TOOTHPASTE DISPENSER AND ORAL HYGIENE ASSEMBLY

(76) Inventor: William T. Wilkinson, P.O. Box 73, Salem, NJ (US) 08079

( * ) Notice: Subject to any disclaimer, the term of this patent is extended or adjusted under 35 U.S.C. 154(b) by 0 days.

This patent is subject to a terminal disclaimer.

(21) Appl. No.: 09/645,093

(22) Filed: Aug. 24, 2000

Related U.S. Application Data

(60) Provisional application No. 60/151,350, filed on Aug. 30, 1999.

(51) Int. Cl.[7] ..... B67D 1/07

(52) U.S. Cl. ..... 222/192; 222/386; 222/320; 222/93

(58) Field of Search ..... 222/93, 192, 320, 222/387, 389, 321.1

(56) References Cited

U.S. PATENT DOCUMENTS

| | | | | | |
|---|---|---|---|---|---|
| 1,858,134 | A | * | 5/1932 | Booth et al. | 132/286 |
| 2,828,891 | A | * | 4/1958 | Murney | 222/192 |
| 3,178,060 | A | * | 4/1965 | Bossack | 222/78 |
| 4,292,705 | A | * | 10/1981 | Stouffer | 15/110 |
| 4,508,239 | A | * | 4/1985 | Rozzen | 222/39 |
| 4,673,106 | A | * | 6/1987 | Fishman | 222/192 |
| 4,776,492 | A | * | 10/1988 | Gallo | 222/192 |
| 4,784,294 | A | * | 11/1988 | Dickinson | 222/93 |
| 4,817,826 | A | * | 4/1989 | Judge | 222/192 |
| 4,827,951 | A | * | 5/1989 | Grussmark | 222/192 |
| D308,475 | S | * | 6/1990 | Gastwirt | D9/448 |
| 4,934,389 | A | * | 6/1990 | Pettiford | 132/325 |
| 4,955,567 | A | * | 9/1990 | Longhurst | 222/192 |
| 5,092,496 | A | * | 3/1992 | Gayle et al. | 222/386 |
| 5,228,595 | A | * | 7/1993 | Booker | 222/192 |
| 5,547,107 | A | * | 8/1996 | Boiardi | 222/1 |
| 5,638,840 | A | * | 6/1997 | Lee et al. | 132/310 |
| 5,676,279 | A | * | 10/1997 | Bastion | 222/93 |
| 5,732,722 | A | * | 3/1998 | Mortvedt | 132/325 |
| 5,842,604 | A | * | 12/1998 | Stahley et al. | 222/95 |
| 5,871,124 | A | * | 2/1999 | Wilkinson | 222/192 |
| 5,979,706 | A | * | 11/1999 | Grussmark | 222/93 |

* cited by examiner

*Primary Examiner*—William C. Doerrler
*Assistant Examiner*—Frederick C Nicolas
(74) *Attorney, Agent, or Firm*—Connolly Bove Lodge Hutz

(57) ABSTRACT

A combined toothpaste dispenser and oral hygiene assembly includes a toothpaste dispenser which is preferably a rigid pump. A holder is mounted to the outer component of the pump for detachably housing at least one oral hygiene or personal care tool. Such tool may be a dental floss dispenser and/or toothbrushes. Preferably, a cover is mounted over the top of the dispenser to provide sanitary protection for the dispenser and the personal care tools and to function as a cup as well as enhancing the aesthetic appearance of the assembly.

15 Claims, 2 Drawing Sheets

COMBINATION TOOTHPASTE DISPENSER AND ORAL HYGIENE ASSEMBLY

CROSS-REFERENCE TO RELATED APPLICATION

This application is based upon provisional application Serial No. 60/151,350, filed Aug. 30, 1999.

BACKGROUND OF THE INVENTION

In my U.S. Pat. No. 5,871,124 I disclose a combination toothpaste dispenser and toothpaste holder. Among the various embodiments in that patent there are also combinations which include various personal care tools in addition to toothbrushes such as dental floss and gum massagers. It would be desirable if there were further variations of combination toothpaste dispensers and different types of oral hygiene personal care items.

In my U.S. Pat. No. 5,887,754 I disclose a toothpaste dispenser which is structured to simulate a tooth. It would be desirable to incorporate such concept of tooth simulation for various oral hygiene assemblies.

SUMMARY OF THE INVENTION

An object of this invention is to provide variations of the embodiments shown in my U.S. Pat. Nos. 5,871,124 and 5,887,754.

In accordance with this invention a toothpaste dispenser, preferably in the form of a pump type dispenser made of rigid components includes structure for holding various oral hygiene or personal healthcare items, particularly, toothbrushes and dental floss.

In a preferred practice of this invention a cap is mounted over the dispenser to serve multiple functions, such as to cover the top of the toothbrushes and to provide a drinking glass. Preferably, the cap is in the shape of a simulated molar since molar is generally of a shape having width and length proportions which lend itself to achieving the above function.

DETAILED DESCRIPTION

In general, one aspect of the invention relates to a combined toothpaste dispenser and oral hygiene assembly wherein one of the personal care tools is dental floss. Reference is made to my U.S. Pat. No. 5,871,124, all of the details of which are incorporated herein by reference thereto. This patent discloses various types of oral hygiene personal care tools which may be included in the practice of this invention. The main emphasis in the present application is for tools which consist of toothbrushes and dental floss.

In general the invention provides aa place or structure which could be at any suitable location on a rigid pump type dispenser to hold, hang, place or store dental floss whether in a cartridge or any other type of container. The storage structure or holder for dental floss could be detachable from the dispenser or could be a permanent component of the dispenser. In the preferred practice of the invention the holder is permanent and is preferably located on the front or back of the dispenser and most preferably on the front where the holder is on the bottom or barrel component of the pump dispenser and where the plunger telescopes into the bottom barrel. In practices where the barrel and spout are the top components which telescope over the base/plunger, then the floss holder is preferably on the top barrel/spout. Thus, the holder is preferably on the outer component, for a telescopic barrel/plunger pump type dispenser.

In the broad practice of the invention the holder can be designed to hold only a single personal care tool which is preferably, but not necessarily, dental floss. The holder, however, can also be designed to accommodate various other tools and particularly toothbrushes.

The holder can be designed to receive a cartridge of dental floss that can be replaced with a new cartridge when the floss is completely used. The holder can be designed to accommodate any type of floss package and/or floss cartridge system.

The holder structure can take various forms, including but not limited to:

1. a shelf or a ledge;
2. a pouch, pocket, bin or compartment;
3. posts/prongs/springs/spring arms that pinch/pressure contain the floss package;
4. a hook;
5. an adhesive strip type material that is secured to the floss package;
6. a ring/loop that, the floss package can be placed into; and
7. a roller/cylinder or roller/cartridge holder that the floss cartridges can be placed into or onto.

One preferred structure for the holder is a simple shelf or shallow pouch compartment on the front center of the pump. The package of dental floss can thus easily be stored in such holder and easily removed for use or replacement. The pouch can be customized to accommodate a specific commercial package of a specific manufacturer so as to encourage brand loyalty.

An alternative preferred structure is to provide a Cutter on the holder or at some other location on the dispenser for cutting the dental floss.

Figure 2:
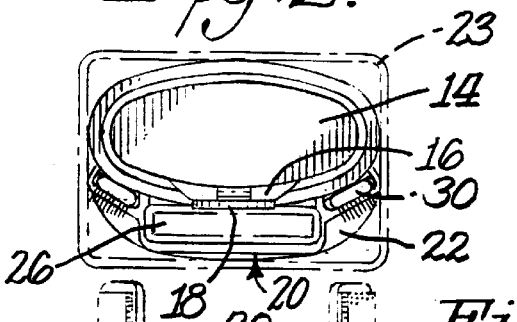
FIG. 2 is a top plan view of the assembly shown in FIG. 1.
Figure 1:
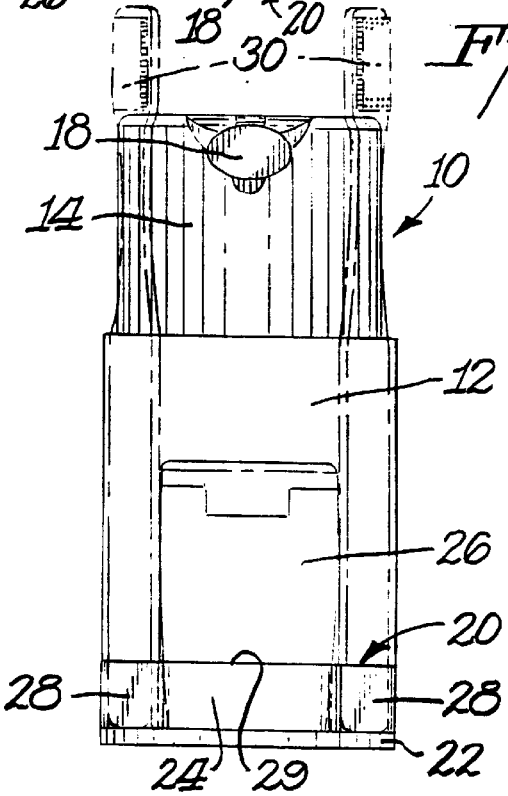
FIG. 1 is a front elevational view of a combination toothpaste dispenser and oral hygiene assembly in accordance with this invention.
Figure 3:
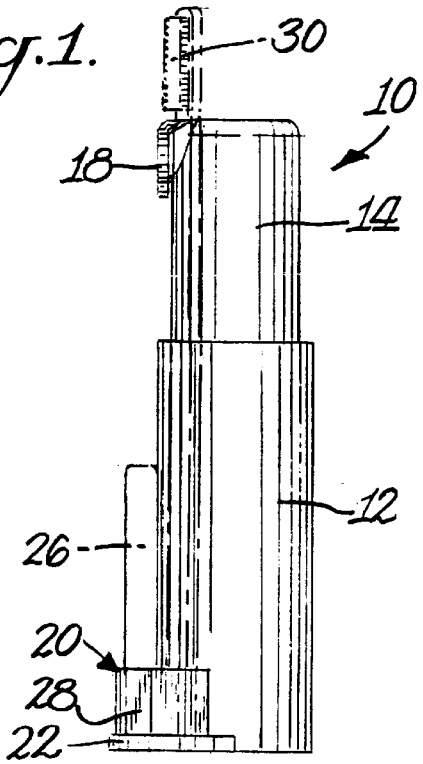
FIG. 3 is a side elevational view of the assembly shown in FIGS. 1–2.

FIGS. 1–3 and FIGS. 6–7 and FIG. 8 show various exemplary practices of this invention. As shown in FIGS. 1–3 the combined toothpaste dispenser and oral, hygiene assembly 10 includes a pump type dispenser which has as its base a rigid. Barrel 12 with a plunger 14 telescoped into a barrel in a known manner. Plunger 14 includes a dispensing spout 16 which may be selectively covered by a cap or protector 18 in a known manner.

In the embodiment shown in FIGS. 1–3 the assembly 10 includes a holder 20 mounted at the base of barrel 12 preferably at the front of barrel 12. Holder 20 may include a flared edge or rim 22 to provide greater stability in setting the assembly 10 on a counter top. Holder 20 is illustrated as being divided into three compartments. The center compartment 24 is of a size and shape to hold a dental floss dispenser 26. The end compartments 28,28 are of a size and shape to hold toothbrushes 30,30. By placing the holder and its oral hygiene personal care tools at the front of the toothpaste dispenser the surface area occupied by the assembly 10 is minimized as compared, for example, to placing the components at the sides of the dispenser. FIG. 2, for example, illustrates the assembly 10 mounted in a carton 23 of rectangular cross section. The addition of the end compartments at the rounded corners of barrel l2 and of the central compartment does not increase the size of the carton needed for packaging the assembly because holder 20 is maintained within the confines of rim 22 which controls the size of the carton.

FIGS. 1–3 illustrate the holder 20 to be integrally molded with the barrel 12. It is to be understood, however, that the holder could be detachably mounted to barrel 12 in any suitable manner such as by having a band which joins the two end compartments 28,28 and which extends around the sides and rear of the barrel 12. Barrel 12 may include surface accommodating structure such as indents to receive and accurately locate holder 20 where holder 20 is detachable.

Although FIGS. 1–3 illustrate holder 20 to form three separate compartments the invention may also be practiced where there is a single compartment and the components such as floss-dispenser 26 and toothbrushes 30,30 are, simply placed juxtaposed each other in the compartment. Alternatively, the single compartment might hold only a single personal-care tool such as the floss dispenser 26. In a further alternative, holder 20 may have two separate compartments for two separate personal care tool's or may have more than three-compartments for a corresponding number of personal care tools.

Figure 6:
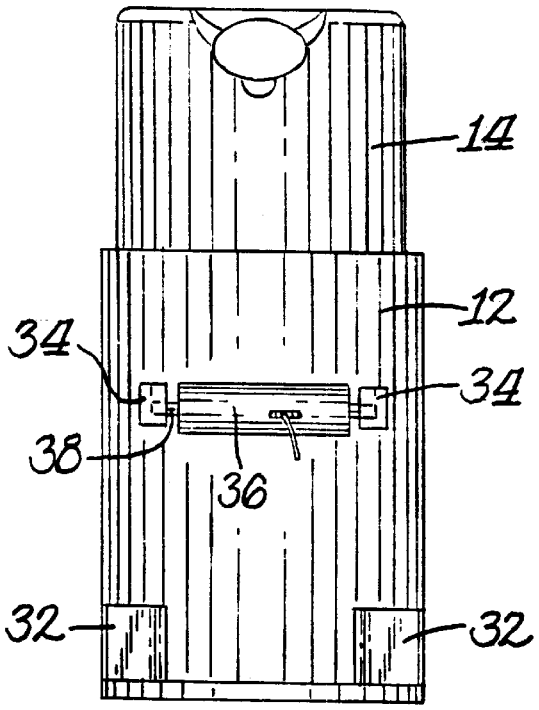
FIG. 6 is a front elevational view of a further combined toothpaste dispenser and oral hygiene assembly in accordance with this invention.
Figure 7:
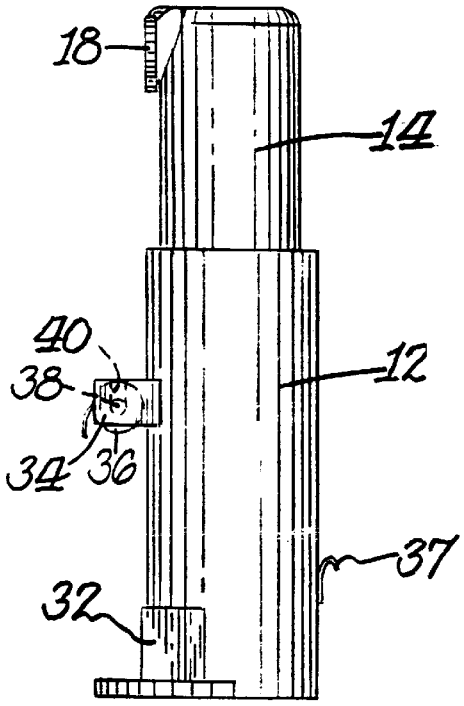
FIG. 7 is a side elevational view of the assembly shown in FIG. 6.

FIGS. 6–7 illustrate a variation of the invention wherein separate holders 32,32 are provided for holding individual items, such as toothbrushes. A third holding structure 34,34 is mounted on barrel 12 for holding a floss dispenser 36. In the illustrated embodiment, holders 34 are in the form of brackets which receive pins 38 that would be connected to the floss cartridge 36. The pins could extend into openings in the floss cartridge or the pins could be permanently secured to the floss cartridge. The brackets may have slots 40 extending downwardly from their tops so that the pins could slide into the brackets. FIG. 7 illustrates the provision of a cutter 37 mounted at the rear portion of barrel 12 for cutting floss. The dental floss may be housed in any conventional manner such as a cartridge, dispenser or reel.

Figure 8:
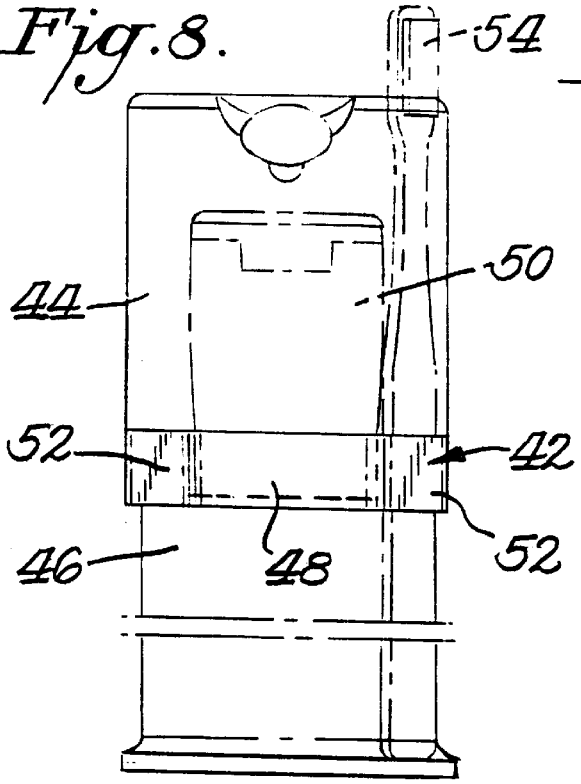
FIG. 8 is a front elevational view of yet another form of combined toothpaste dispenser and oral hygiene assembly in accordance with this invention.

FIG. 8 is included to illustrate a practice of the invention where the holder 42 is mounted to the upper member. In this case the upper member 44 is a barrel which telescopes over the lower member or plunger 46. Holder 42 could be of any suitable structure such as having the same structure as holder 20 with a central compartment 48 for the floss dispenser 50 and with end compartments, 52 for the toothbrushes 54. If desired, a cutter could be provided for assembly 10 at any suitable location. For example, a portion of the upper edge 29 of holder 20 in FIGS. 1–3 could be beveled to function as a cutter for the floss. The cutter could be a separate member, such as a cutter 37 in FIG. 7. Such cutter is useful where the dental floss cartridge or dispenser does not include its own cutter.

A further aspect of this invention is the provision of a detachable cover which has multiple functions. In this aspect, the invention utilizes a cap top or cover on an oral care package, preferably a toothpaste pumper a soft tube or even a mouthwash bottle. The cover is preferably shaped as a simulated tooth, such as a molar. This aspect of the invention lends itself to a company creating a complete line of products with a strong brand/logo identity in the oral care/dental market. In general, the cap or cover could be of any size, shape or design and could attach by any suitable means such as a pressure fit, snap, screw, etc. or could simply rest on the top of the dispenser. The cap would have a multiple of uses depending on the end product. Examples of such uses are:

1. Decorative, brand building ornamental top;
2. Dust, sanitary, protective cover;
3. Drinking/gargling cup for water or mouthwash; and
4. Closure, seal for content.

The preferred form of cover would be for a toothpaste dispenser and more preferably for a toothpaste dispenser of the pump type. For such use the cover would have the desirable functions of:

1. Decorative top;
2. Sanitary, protective dust cover for dust covers or oral hygiene personal care tools; and
3. Drinking, swilling, gargling cup for mouthwash, water, etc.

The cover can relate to the pump and tools in the following ways:

1. The cover can touch or rest on the tools;
2. The cover can touch both the tools and the dispenser; and
3. The cover can touch just the dispenser.

The cover can also have a single or multiple cavities. Preferably the cover would cover the dental instruments on the dispenser. Alternatively, the instruments could be disposed outside of the cover. The cover could also include structure where dental instruments, including toothbrushes, floss dispensers, etc. could hang or be stored preferably on the outside of the cover.

The inside of the cover would preferably cover the main body or top of the dispenser and pockets on the outside of the cover could cover toothbrushes or other tools including the floss dispenser.

In the preferred practice of this aspect of the invention the cover has a single cavity. When inverted the cover can be used as a drinking/gargling cup. If desired, the cover can also form a base into which the dispenser can fit for storage purposes.

When the pump dispenser is full, the cover fits over the top of the pump and can have a cut out on its front to accommodate the spout. As the top is pushed down, then when the cover is replaced, it will hang over or on the top of the toothbrushes or other dental instruments and would not contact the pump dispenser although such contact is possible.

Figure 4:
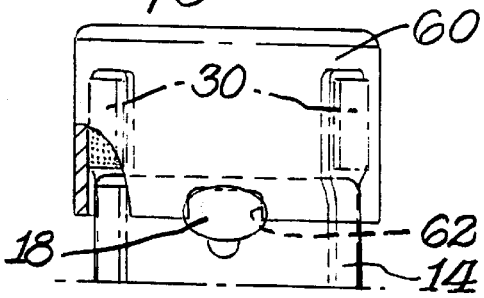
FIG. 4 is a fragmental front elevational view showing a cover over the top of the dispenser.
Figure 5:
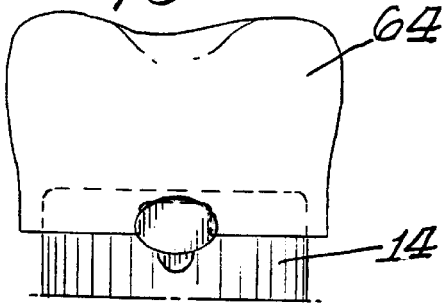
FIG. 5 is a view similar to FIG. 4 showing an alternative shape for the cover.
Figure 9:
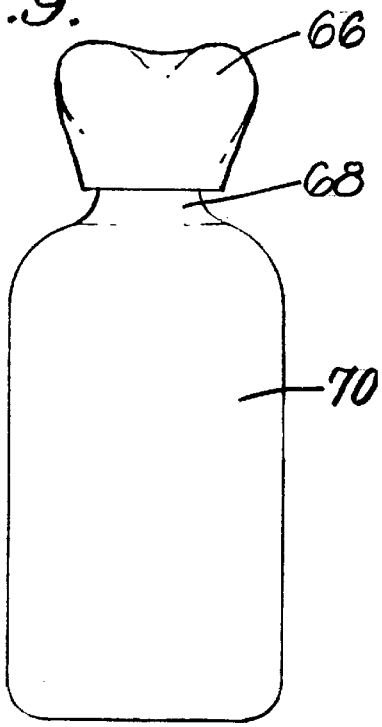
FIG. 9 is a front elevational view of a combined Mouthwash dispenser and cap in accordance with a further aspect of this invention.

FIGS. 4–5 and 9 illustrate practices of this invention using the cover feature. As shown in FIG. 4 the cover 60 is of generally oval shape with a flat top and vertical walls to fit over plunger 14. Cover 60 includes an indent or cut-out 62 to accommodate the spout and its cover 18. Cover 60 is of a size and shape to permit the upper ends of toothbrushes 30 to extend into the cover. The cover thereby acts as a protective cover or shield for the toothbrushes and particularly for the brush portions of the toothbrush. As a result, cover 60 provides more sanitary conditions for the toothbrushes.

Cover 60 could be mounted on plunger 14 in any suitable manner, such as being snapped on the plunger. When cover 60 is removed the toothbrushes 30,30 can be removed, from holder 20. Cover 60 can also then function as a cup as previously described.

FIG. 5 illustrates a variation of the invention where the cover 64 is shaped to simulate a molar. Cover 64 would otherwise function in the same manner as cover 60.

FIG. 9 shows a further use of the invention where cover 66 is simulated as a molar and fits over the neck 68 of a bottle 70 to act as a cap or a cover for the bottle 70. Bottle 70 may contain any substance such as mouthwash.

One of the advantages of the present invention is that by the inclusion of the holders on the toothpaste dispenser and also by the provision of a cover which can function as a cup, the assembly acts as a sink top organizer to eliminate the necessity to have various personal care items scattered about the sink top.

What is claimed is:

1. A combined toothpaste dispenser and oral hygiene assembly comprising a toothpaste dispenser, said toothpaste dispenser being a rigid pump dispenser having a rigid shape outer member and a rigid shape inner member telescopically arranged with respect to each other and having a dispensing spout whereby toothpaste is dispensed through said spout when said inner member and said outer member are pushed together in a contracting telescopic movement, holding structure on said outer member, said holding structure being mounted externally of said outer member to be readily accessible, a supply of dental floss detachably held by said holding structure, said supply of dental floss being disposed entirely externally of said outer member in an exposed condition while held by said holding structure to facilitate the mounting of said supply of dental floss to said holding structure externally of said outer member, said holding structure comprising a shelf, and said dental floss supply being a cartridge resting on said shelf.

2. A combined toothpaste dispenser and oral hygiene assembly comprising a toothpaste dispenser, said toothpaste dispenser being a rigid pump dispenser having a rigid shape outer member and a rigid shape inner member telescopically arranged with respect to each other and having a dispensing spout whereby toothpaste is dispensed through said spout when said inner member and said outer member are pushed together in a contracting telescopic movement, holding structure on said outer member, said holding structure being mounted externally of said outer member to be readily accessible, a supply of dental floss detachably held by said holding structure, said supply of dental floss being disposed entirely externally of said outer member in an exposed condition while held by said holding structure to facilitate the mounting of said supply of dental floss to said holding structure externally of said outer member said holding structure comprising a pocket, said supply of said dental floss being placed in said pocket, and said pocket having an open top to permit the ready removal and replacement of said supply of dental floss into and out of said pocket.

3. The assembly of claim 2 including at least one toothbrush detachably mounted to said outer member.

4. The assembly of claim 2 wherein said outer member is a barrel for being located directly on a support surface, said inner member being a plunger mounted above said barrel and movable into and out of said barrel, and said spout being on said plunger.

5. The assembly of claim 2 wherein said holding structure is permanently mounted to said outer member.

6. The assembly of claim 2 wherein said holding structure is integral with said outer member.

7. The assembly of claim 2 wherein said inner member is a lower member for resting on a support surface, and said outer member is telescopically mounted over and around said inner member for inward and outward movement around said inner member.

8. The assembly of claim 2 including a cutter on said holding structure.

9. The assembly of claim 2 wherein said pocket is compartmentalized having a least two individual compartments, and said supply of dental floss being located in one of said compartments.

10. The assembly of claim 4 wherein a toothbrush is located in at least one of said compartments.

11. The assembly of claim 4 wherein a gum massage tool is located in one of said compartments.

12. A combined toothpaste dispenser and oral hygiene assembly comprising a toothpaste dispenser, said toothpaste dispenser being a rigid pump dispenser having a rigid shape outer member and a rigid shape inner member telescopically arranged with respect to each other and having a dispensing spout whereby toothpaste is dispensed through said spout when said inner member and said outer member are pushed together in a contracting telescopic movement, holding structure on said outer member, said holding structure being mounted externally of said outer member to be readily accessible, a supply of dental floss detachably held by said holding structure, said supply of dental floss being disposed entirely externally of said outer member in an exposed condition while held by said holding structure to facilitate the mounting of said supply of dental floss to said holding structure externally of said outer member, said holding structure including a hook, and said supply of dental floss being held by said hook.

13. A combined toothpaste dispenser and oral hygiene assembly comprising a toothpaste dispenser, said toothpaste dispenser being a rigid pump dispenser having a rigid shape outer member and a rigid shape inner member telescopically arranged with respect to each other and having a dispensing spout whereby toothpaste is dispensed through said spout when said inner member and said outer member are pushed together in a contracting telescopic movement, holding structure on said outer member, said holding structure being mounted externally of said outer member to be readily accessible, a supply of dental floss detachably held by said holding structure, said supply of dental floss being disposed entirely externally of said outer member in an exposed condition while held by said holding structure to facilitate the mounting of said supply of dental floss to said holding structure externally of said outer member, said holding structure including a layer of adhesive, and said supply of dental floss being adhesively held to said layer of adhesive.

14. A combined toothpaste dispenser and oral hygiene assembly comprising a toothpaste dispenser, said toothpaste dispenser being a rigid pump dispenser having a rigid shape outer member and a rigid shape inner member telescopically arranged with respect to each other and having a dispensing spout whereby toothpaste is dispensed through said spout when said inner member and said outer member are pushed together in a contracting telescopic movement, holding structure on said outer member, said holding structure being mounted externally of said outer member to be readily accessible, a supply of dental floss detachably held by said holding structure, said supply of dental floss being disposed entirely externally of said outer member in an exposed condition while held by said holding structure to facilitate the mounting of said supply of dental floss to said holding structure externally of said outer member, said outer member being a barrel for being located directly on a support surface, said inner-member being a plunger mounted above said barrel and movable into and out of said barrel, said spout being on said plunger, and said holding structure being located on a front portion of said barrel.

15. The assembly of claim 14 wherein said holding structure comprises a pocket, and said supply of said dental floss being placed in said pocket.

* * * * *